US008702825B2

(12) United States Patent
Shen et al.

(10) Patent No.: US 8,702,825 B2
(45) Date of Patent: Apr. 22, 2014

(54) COMPOSITE CUTTER SUBSTRATE TO MITIGATE RESIDUAL STRESS

(75) Inventors: Yuelin Shen, Spring, TX (US); Youhe Zhang, Spring, TX (US); Jibin Shi, Spring, TX (US); Yuri Burhan, Spring, TX (US); Gregory T. Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 408 days.

(21) Appl. No.: 13/024,133

(22) Filed: Feb. 9, 2011

(65) Prior Publication Data

US 2011/0192652 A1 Aug. 11, 2011

Related U.S. Application Data

(60) Provisional application No. 61/302,701, filed on Feb. 9, 2010.

(51) Int. Cl.
*B24D 18/00* (2006.01)

(52) U.S. Cl.
USPC ..... 51/307; 51/293

(58) Field of Classification Search
USPC ..... 175/327–435
See application file for complete search history.

(56) References Cited

U.S. PATENT DOCUMENTS

| | | | | |
|---|---|---|---|---|
| 2,941,241 | A | | 6/1960 | Strong |
| 2,941,248 | A | | 6/1960 | Hall |
| 2,947,611 | A | | 8/1960 | Bundy |
| 3,609,818 | A | | 10/1971 | Wentorf, Jr. |
| 3,767,371 | A | | 10/1973 | Wentorf, Jr. et al. |
| 4,104,344 | A | | 8/1978 | Pope et al. |
| 4,288,248 | A | | 9/1981 | Bovenkerk et al. |
| 4,289,503 | A | | 9/1981 | Corrigan |
| 4,525,178 | A | | 6/1985 | Hall |
| 4,673,414 | A | | 6/1987 | Lavens et al. |
| 4,694,918 | A | | 9/1987 | Hall |
| 4,944,772 | A | * | 7/1990 | Cho ..... 51/293 |
| 4,954,139 | A | | 9/1990 | Cerutti |
| 5,120,327 | A | * | 6/1992 | Dennis ..... 51/293 |
| 5,127,923 | A | | 7/1992 | Bunting et al. |
| 5,370,195 | A | | 12/1994 | Keshavan et al. |
| 5,711,702 | A | | 1/1998 | Devlin |

(Continued)

FOREIGN PATENT DOCUMENTS

| | | |
|---|---|---|
| EP | 0989282 A2 | 3/2000 |
| GB | 2335682 A | 9/1999 |

(Continued)

OTHER PUBLICATIONS

Examination Report issued in corresponding British Application No. 1207667.5 dated Dec. 31, 2012 (2 pages).

(Continued)

*Primary Examiner* — Kaj K Olsen
*Assistant Examiner* — Jared Wood
(74) *Attorney, Agent, or Firm* — Osha Liang LLP

(57) ABSTRACT

A method of forming a cutting element that includes filling at least one non-planar region on an upper surface of a carbide substrate with a diamond mixture, subjecting the substrate and the diamond mixture to high pressure high temperature sintering conditions to form a reduced-CTE substrate having polycrystalline diamond that extends a depth into the reduced-CTE substrate in an interface region, and an upper surface made of a composite surface of diamond and carbide, and attaching a polycrystalline diamond body to the composite surface of the reduced-CTE substrate is disclosed.

37 Claims, 9 Drawing Sheets

(56) References Cited

U.S. PATENT DOCUMENTS

| | | | | |
|---|---|---|---|---|
| 6,068,913 | A * | 5/2000 | Cho et al. | 428/212 |
| 6,196,341 | B1 | 3/2001 | Chaves | |
| 6,286,498 | B1 | 9/2001 | Sung | |
| 6,454,027 | B1 * | 9/2002 | Fang et al. | 175/374 |
| 7,350,599 | B2 | 4/2008 | Lockwood et al. | |
| 7,628,234 | B2 * | 12/2009 | Middlemiss | 175/434 |
| 2006/0081402 | A1 | 4/2006 | Lockwood et al. | |
| 2008/0185189 | A1 * | 8/2008 | Griffo et al. | 175/433 |
| 2008/0223623 | A1 | 9/2008 | Keshavan et al. | |
| 2008/0230280 | A1 | 9/2008 | Keshavan et al. | |
| 2009/0313908 | A1 | 12/2009 | Zhang et al. | |
| 2011/0024201 | A1 * | 2/2011 | Scott et al. | 175/428 |

FOREIGN PATENT DOCUMENTS

| | | | |
|---|---|---|---|
| GB | 2335685 | A | 9/1999 |
| GB | 2481313 | A | 12/2011 |
| WO | 2011017592 | A2 | 2/2011 |
| WO | 2012009285 | A1 | 1/2012 |

OTHER PUBLICATIONS

Combined Search and Examination Report issued in related British Patent Application No. 1102182.1; Dated Mar. 10, 2011 (7 pages).

Combined Search and Examination Report issued in related British Patent Application No. 1207667.5; Dated May 31, 2012 (6 pages).

Office Action issued in corresponding Chinese Application No. 201110036218.9 dated Apr. 19, 2013 (33 pages).

Examination Report issued in corresponding British Application No. 1207667.5 dated Jul. 29, 2013 (2 pages).

Office Action issued in corresponding Chinese Application No. 201110036218.9; Dated Jan. 10, 2014 (32 pages).

* cited by examiner

Prior Art

COMPOSITE CUTTER SUBSTRATE TO MITIGATE RESIDUAL STRESS

CROSS-REFERENCE TO RELATED APPLICATIONS

Pursuant to 35 U.S.C. §119(e), this application claims priority to U.S. Provisional Application 61/302,701, filed on Feb. 9, 2010, which is herein incorporated by reference in its entirety.

BACKGROUND OF INVENTION

1. Field of the Invention

Embodiments disclosed herein relate generally to composite cutting structures.

More particularly, embodiments disclosed herein relate to polycrystalline diamond cutting elements formed to mitigate the residual stresses contained therein.

2. Background Art

Polycrystalline diamond compact ("PDC") cutters have been used in industrial applications including rock drilling and metal machining for many years. In a typical application, a compact of polycrystalline diamond ("PCD") (or other superhard material, such as polycrystalline cubic boron nitride) is bonded to a substrate material, which is typically a sintered metal-carbide to form a cutting structure. PCD comprises a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

PCD may be formed by subjecting a volume of diamond grains to certain high-pressure/high-temperature ("HPHT") conditions in the presence of a sintering aid or binder. Conventionally, the sintering aid or binder is provided in the form of a solvent metal catalyst material, such as one or more elements from Group VIII of the Periodic table. The solvent metal catalyst may be added and mixed with the diamond grains prior to HPHT processing and/or may be provided during the HPHT process by infiltration from a substrate comprising the solvent metal catalyst as one of its constituent materials.

A conventional PDC cutter may be formed by placing a cemented carbide substrate into a HPHT container. A mixture of diamond grains or diamond grains and catalyst binder is placed atop the substrate in the container and the container is loaded into a HPHT device that is configured and operated to subject the container and its contents to a desired HPHT condition. In doing so, metal binder migrates from the substrate and passes through the diamond grains to promote intergrowth between the diamond grains. As a result, the diamond grains become bonded to each other to form the diamond layer, and the diamond layer is in turn bonded to the substrate. The substrate often comprises a metal-carbide composite material, such as tungsten carbide. The deposited diamond body is often referred to as a "diamond layer", a "diamond table", or an "abrasive layer."

An example of a drag bit for earth formation drilling having PDC conventional cutters is shown in FIG. 1. In FIG. 1, a drill bit 10 has a bit body 12. The lower face of the bit body 12 is formed with a plurality of blades 14, which extend generally outwardly away from a central longitudinal axis of rotation 16 of the drill bit. A plurality of cutters 18 are disposed side by side along the length of each blade. The number of cutters 18 carried by each blade may vary. The cutters 18 are individually brazed to a stud-like carrier (or substrate), which may be formed from tungsten carbide, and are received and secured within sockets in the respective blade.

Conventional PCD includes 85-95% by volume diamond and a balance of the binder material, which is present in PCD within the interstices existing between the bonded diamond grains. Binder materials that are typically used in forming PCD include Group VIII elements, with cobalt (Co) being the most common binder material used.

Conventional PCD is stable at temperatures of up to 700-750° C., after which observed increases in temperature may result in permanent damage to and structural failure of PCD. In particular, heat caused by friction between the PCD and the work material causes thermal damage to the PCD in the form of cracks, which lead to spalling of the diamond layer and delamination between the diamond layer and substrate. This deterioration in PCD is due to the significant difference in the coefficient of thermal expansion of the binder material, which is typically cobalt, as compared to diamond. Upon heating of PCD, the cobalt and the diamond lattice will expand at different rates, which may cause cracks to form in the diamond lattice structure and result in deterioration of the PCD. High operating temperatures may also lead to back conversion of the diamond to graphite causing loss of microstructural integrity, strength loss, and rapid abrasive wear.

In order to overcome this problem, strong acids may be used to "leach" the cobalt from the diamond lattice structure (either a thin volume or the entire body) to at least reduce the damage experienced from different expansion rates within a diamond-cobalt composite during heating and cooling. Examples of "leaching" processes can be found, for example, in U.S. Pat. Nos. 4,288,248 and 4,104,344. Briefly, a strong acid, typically nitric acid or combinations of several strong acids (such as nitric and hydrofluoric acid) may be used to treat the diamond table, removing at least a portion of the co-catalyst from the PDC composite. By leaching out the cobalt, thermally stable polycrystalline ("TSP") diamond may be formed. In certain embodiments, only a select portion of a diamond composite is leached, in order to gain thermal stability with less effect on impact resistance. As used herein, the term thermally stable polycrystalline (TSP) includes both of the above (i.e., partially and completely leached) compounds. Interstitial volumes remaining after leaching may be reduced by either furthering consolidation or by reinfiltrating the volume with a secondary material. An example of reinfiltration can be found in U.S. Pat. No. 5,127,923.

However, some of the problems described above that plague PCD cutting elements, i.e., chipping, spalling, partial fracturing, cracking or exfoliation of the cutting table, are also often encountered in TSP cutters or other types of cutters having an ultra hard diamond-like cutting table such as polycrystalline cubic boron nitride (PCBN) bonded on a cemented carbide substrate. In particular, it has been observed that TSP cutters are slightly more prone to spalling and delamination under severe loads. These problems result in the early failure of the cutting table and thus, in a shorter operating life for the cutter.

These problems, i.e., chipping, spalling, partial fracturing, cracking, and exfoliation of the PDC diamond layer may be caused in part by the difference in the coefficient of thermal expansion between the diamond and the substrate. Specifically, as shown in FIG. 5A, a cemented carbide substrate 53 has a higher coefficient of thermal expansion than a diamond layer 58. Thus, during sintering, for example, both the cemented carbide body 53 and diamond layer 58 are heated to elevated temperatures forming a bond between the diamond layer 58 and the cemented carbide substrate 53. As the diamond layer 58 and substrate 53 cool down, the substrate 53 shrinks more than the diamond 58 because of the carbide's higher coefficient of thermal expansion. Consequently, stresses referred to as thermally induced stresses, or residual stresses, are formed at the interface between the diamond and the substrate. Further, different contractions between the diamond layer and carbide substrate generate stresses in both bodies.

Moreover, as shown in FIG. 5B, residual stresses are formed on the diamond layer 58 from a mismatch in the bulk modulus between the diamond layer 58 and substrate 53. Specifically, the high pressure applied during the sintering process causes the carbide 53 to compress more than the diamond layer 58 due to the carbide's lower bulk modulus. After the diamond 58 is sintered onto the carbide 53 and the pressure is removed, the carbide 53 tries to expand more than the diamond 58 imposing a tensile residual stress on the diamond layer 58. These stresses may induce larger stresses, which may ultimately lead to material failure, because diamond and substrate materials typically have a high modulus (i.e., stiffness).

The cooling down effect shown in FIG. 5A (caused by different coefficients of thermal expansion) and the pressure release effect shown in FIG. 5B (caused by different bulk modulus) counteract with each other. As shown in FIG. 5C, the cooling down effect over powers the pressure release effect under commonly used sintering conditions, thereby leaving different net contractions in the diamond layer 58 and carbide substrate 53.

In an attempt to overcome these problems, many have turned to use of non-planar interfaces between the substrate and a PDC cutting layer. The belief being, that a non-planar interface allows for a more gradual shift in the coefficient of thermal expansion from the substrate to the diamond table, thus, reducing the magnitude of the residual stresses on the diamond. Similarly, it is believed that the non-planar interface allows for a more gradual shift in the compression from the diamond layer to the carbide substrate.

Additionally, the formation of a non-planar interface becomes more difficult to achieve when sintering a preformed diamond layer to a carbide substrate because any imprecision between mating non-planar surfaces of the diamond and substrate may cause cracking in the diamond layer.

Accordingly, there exists a continuing need for developments in cutting elements that possess reduced residual stresses therein.

SUMMARY OF INVENTION

In one aspect, embodiments disclosed herein relate to a method of forming a cutting element, which includes filling at least one non-planar region on an upper surface of a carbide substrate with a diamond mixture comprising diamond particles, subjecting the substrate and the diamond mixture to high pressure high temperature sintering conditions to form a reduced-CTE substrate having polycrystalline diamond that extends a depth into the reduced-CTE substrate in an interface region, and an upper surface that comprises a composite surface of diamond and carbide, and attaching a polycrystalline diamond body to the composite surface of the reduced-CTE substrate.

In another aspect, embodiments disclosed herein relate to a method of forming a cutting element, which includes providing a plurality of carbide particles and a plurality of diamond particles, subjecting the plurality of carbide particles and the plurality of diamond particles to high pressure high temperature sintering conditions to form a reduced-CTE substrate having an upper surface at least partially formed from carbide, and attaching a polycrystalline diamond body to the upper surface of the reduced-CTE substrate.

Other aspects and advantages of the invention will be apparent from the following description and the appended claims.

DETAILED DESCRIPTION

Figure 1:
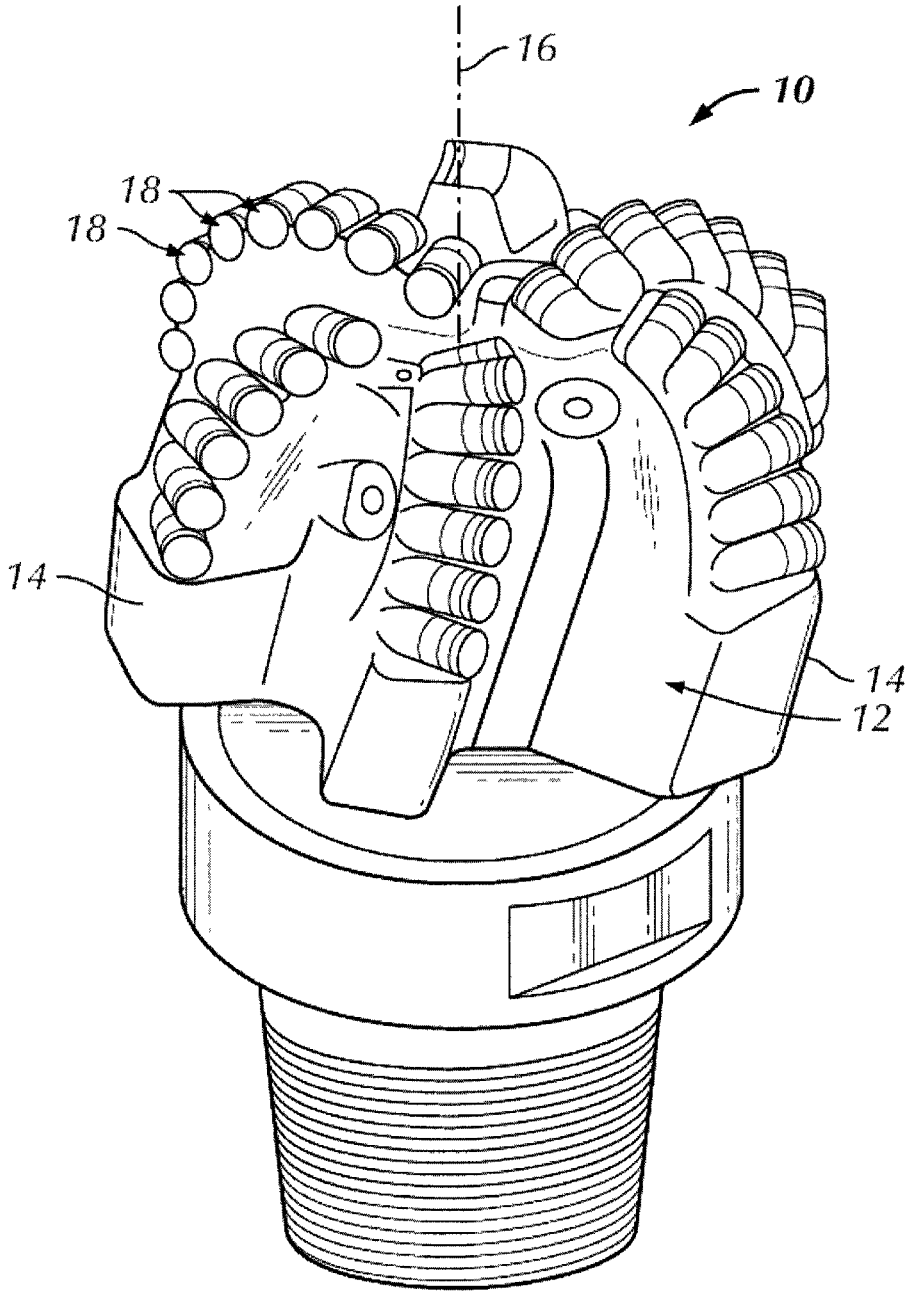
FIG. 1 (Prior Art)
FIG. 1 is an illustration of a drag drill bit.

In one aspect, embodiments disclosed herein relate to PCD and TSP diamond (or other polycrystalline abrasive bodied) cutting elements having reduced residual stresses and methods for forming the same. More specifically, embodiments disclosed herein are directed to PCD and/or TSP diamond cutting elements having an interface region with a reduced coefficient of thermal expansion and increased bulk modulus.

As used herein, the term "PCD" refers to polycrystalline diamond that has been formed, at high pressure/high temperature ("HPHT") conditions, through the use of a solvent metal catalyst, such as those included in Group VIII of the Periodic table. The term "thermally stable polycrystalline diamond" or "TSP," as used herein, refers to intercrystalline bonded diamond that includes a volume or region that has been rendered substantially free of the solvent metal catalyst used to form PCD, or the solvent metal catalyst used to form PCD remains in the region of the diamond body but is otherwise reacted or rendered ineffective in its ability to adversely impact the bonded diamond at elevated temperatures as discussed above.

In a typical application, a polycrystalline diamond compact (PDC) body or other superhard material is attached to a substrate material, which is typically a sintered metal-carbide, to form a cutting structure. Such PDC bodies may include, for example, conventional PCD, high density PCD (diamond content greater than 92 percent by volume), TSP diamond (substantially free of secondary phases), and/or non-conventional PCD having a thermally stable secondary phase. Attachment to a substrate allows for attachment of the PDC cutter to cutting and/or wear devices by conventional methods, such as brazing, welding, etc. Without a substrate, a PDC body must be attached to the cutting and/or wear device by interference fit, which is not practical and does not provide a strong attachment to promote a long service life. As discussed in greater detail below, in some embodiments of the present disclosure, the polycrystalline diamond body may be attached to the substrate during the formation of the polycrystalline diamond body while in other embodiments, the polycrystalline diamond body may be attached to the substrate after formation of the polycrystalline diamond body.

With any of the above-mentioned types of cutting elements, the strong difference between the coefficients of thermal expansion ("CTE") and bulk modulus of a polycrystalline diamond body and a carbide substrate create high residual stresses within the cutting element, particularly at the outer diameter, which is also responsible for cutting. These residual stresses will often lead to chips and/or cracks, which may lead to spalling of the diamond layer, delamination between the diamond and substrate, etc. In particular, radial and hoop stresses may lead to vertical cracking while axial and shear stresses may lead to spalling. Thus, embodiments disclosed herein relate to a substrate having a reduced coefficient of thermal expansion ("a reduced-CTE substrate") in the formation of a polycrystalline diamond cutting element. Some embodiments relate to and attachment (or reattachment) of a diamond body to the reduced-CTE substrate to form a cutting structure, such that the difference between the CTE and bulk modulus of the substrate and diamond body is reduced, while other embodiments relate to the formation of a polycrystalline diamond body on a reduced-CTE substrate.

Formation of a Reduced-CTE Substrate/Interface Region

As used herein, "reduced-CTE substrate" refers to a substrate having both diamond and carbide materials in an upper portion thereof (in what will become the interface region of the substrate upon attachment of a diamond body to the substrate) such that the coefficient of thermal expansion for the substrate is reduced, as compared to the carbide material alone. The term "interface region" refers to a region of the reduced-CTE substrate extending a depth into the reduced-CTE substrate from the upper surface thereof. Diamond in an interface region of a reduced-CTE substrate may preferably extend a depth greater than 0.25 mm from the upper surface of the reduced-CTE substrate, and more preferably extend a depth greater than 0.5 mm, and most preferably extend a depth greater than 1 mm. In some embodiments, diamond may extend the full length of the reduced-CTE substrate.

Additionally, in accordance with embodiments of the present disclosure, the upper surface of the reduced-CTE substrate may be at least partially formed of carbide. In some embodiments of the present disclosure, an upper surface may be formed of diamond regions and carbide regions along at least a portion of the upper surface. Other embodiments of the present disclosure may have an upper surface formed entirely of carbide, with at least a portion of the reduced-CTE substrate inward from the upper surface (in the interface region) having diamond formed therein. Such diamond regions within the reduced-CTE substrate may include, for example, conventional PCD, high density PCD, non-conventional PCD having a thermally stable secondary phase, diamond grit and/or diamond powder.

The reduced-CTE substrate may be formed through a HPHT process from diamond powder and a carbide body (or carbide powder), such that the reduced-CTE substrate has diamond contained therein and along a portion of the upper surface of the carbide body. In accordance with the present disclosure, formation of diamond-filled regions involves forming a desired geometry (i.e., non-planar regions) in a carbide substrate, such that the carbide substrate has a non-planar upper surface, and placing diamond particles within the non-planar regions of the non-planar upper surface. The carbide substrate and diamond particles are then placed in a reaction cell and the cell contents are subjected to HPHT conditions to cause diamond to diamond bonding between the diamond particles (creating PCD-filled regions) and the reduced-CTE substrate. Alternatively, enough diamond powder may be used so that a height of PCD may rise above the carbide substrate (forming a PCD layer). After formation, this excess diamond may be removed to expose carbide at the upper surface (which will become the interface surface upon attachment to another diamond body) of the reduced-CTE substrate. Thus, in this embodiment a composite surface (having two different materials) is created by forming PCD-filler in the non-planar upper surface of a carbide substrate, such that the composite surface includes both diamond and carbide material.

The non-planar upper surface in the carbide substrate may be formed by removal of carbide substrate material from the upper surface of the carbide substrate (creating non-planar regions). Such non-planar regions may be formed using any technique known in the art, including, for example, cutting and etching methods such as EDM machining, grit blasting, etc. Alternatively, the non-planar upper surface may be formed by sintering carbide material in a mold having the corresponding desired geometry of the resulting substrate.

In embodiments where diamond does not form a significant part of the upper surface of the reduced-CTE substrate, diamond particles (or other diamond bodies, such as PCD segments of the various types of PCD described above) may be incorporated into the carbide substrate, such as during the formation of the carbide green body, and then sintered to form a reduced-CTE substrate. This may include embodiments concerning layer(s) of polycrystalline diamond behind the upper surface of the substrate or diamond impregnated or dispersed through the substrate. Sintering processes may include, for example, conventional sintering, spark plasma sintering, and microwave sintering. To reduce diamond graphitization during sintering, diamond particles or PCD/TSP bodies may be coated with a protection material, such as TiC and SiC.

In some embodiments, reduced-CTE substrates having diamond impregnated or dispersed therein may be formed from pelletized diamond grits, such as described in U.S. Pat. No. 7,350,599. Pelletized diamond grits may be hot-pressed to form a grit hot pressed insert ("GHI") substrate, i.e., a reduced-CTE substrate. Further, reduced-CTE substrates formed from pelletized diamond grits may also comprise diamond-filled regions, which may be formed according to methods described above. Alternatively, pelletized diamond grits may be placed proximate to an already formed diamond table, or to a layer of diamond powder, and subjected to HPHT processing to form a cutting element comprising a reduced-CTE substrate and a diamond cutting table.

Pelletized diamond grits may be formed by uniformly encapsulating diamond particles with a matrix material. An exemplary method for achieving a "uniform" encapsulant layer is to mix the diamonds, matrix material powder, and a binder in a commercial mixing machine such as a Turbula Mixer or similar machine used for blending diamonds with matrix material. The resultant mix is then processed through a "granulator" in which the mix is extruded into short "sausage" shapes which are then rolled into balls and dried. The granules that are so formed must be separated using a series of mesh screens in order to obtain the desired yield of uniformly encapsulated crystals. At the end of this process, a number of particles of approximately the same size and shape can be collected. Another exemplary method for achieving a uniform encapsulant layer on the crystals is to use a machine called a Fuji Paudal pelletizing machine.

As used herein, the term "encapsulant layer" refers to a surrounding material that is not chemically reacted to the core primary particles, as compared to a "coating" which is chemically bonded to the substrate. As used herein, the term "uniform" means that that individual diamond particles have similar amounts of encapsulating material (i.e., they have relatively the same size), in approximately the same shape (e.g. spherical layer), and that single diamond crystals are encapsulated rather than diamond clusters. The term "uniformly" is not intended to mean that all the particles have the exact same size or exact same amount of encapsulant or that there are not any discontinuities in the encapsulant layer, but simply that when compared to prior art coated crystals, they are substantially more uniform. Encapsulating uniformity permits the use of a minimal encapsulant layer thickness, thus allowing an increased diamond concentration to be used. In addition, using diamond particles having a uniform matrix powder encapsulating layer over each diamond crystal provides consistent spacing between the diamonds in the finished parts.

In particular, by using pelletized diamond grits to form a reduced-CTE substrate, diamond particles may be more uniformly distributed throughout the impregnated structure. Distribution of the diamond particles may be referred to in terms of diamond "contiguity," which is a measure of the number of diamonds that are in direct contact with another diamond. Ideally, if complete distribution existed, the diamond to diamond contiguity would be 0% (i.e., no two diamonds are in direct contact). By contrast, analysis of typical currently used impregnated cutting structures has revealed a diamond contiguity of approximately 50% (i.e., approximately half of the diamonds are in contact with other diamonds). In some embodiments, the portions of reduced-CTE substrates formed from pelletized diamond grits may have diamond contiguity ranging from 0%-15%. In other embodiments, diamond contiguity may range from 0%-10%. In still other embodiments, diamond contiguity may range from 0%-5%.

In a preferred embodiment, the size/volume of diamond regions formed in a reduced-CTE substrate is designed to mitigate residual stresses in a PDC cutter. Residual stresses may generally be caused by the differences in the coefficient of thermal expansion ("CTE") between the diamond (including PCD and TSP) and the carbide substrate of a cutter. By controlling the content of diamond and carbide materials in the substrate near the interface surface (i.e., in an interface region), the thermal expansion rate of the substrate can be adjusted based on:

$$\alpha_{total} = \sum_i \alpha_i V_i$$

where $\alpha_i$ is the coefficient of thermal expansion (i.e., thermal expansion ratio) and $V_i$ is the volume fraction of the $i^{th}$ component. For example, if the thermal expansion ratio of PDC is $2.5\times10^{-6}$ m/m-° C. and the thermal expansion ratio of a carbide substrate is $5.8\times10^{-6}$ m/m-° C., by forming an interface region in the substrate that includes 50 percent by volume PDC and 50 percent by volume of carbide, the total thermal expansion ratio of the interface region will be $4.15\times10^{-6}$ m/m-° C., which is about 30 percent lower than the carbide substrate alone. Thus, by lowering the total thermal expansion ratio in the substrate, the difference between the substrate thermal expansion ratio and the PDC table thermal expansion ratio may be significantly reduced, which thereby reduces the amount of residual stresses in the cutter.

Further, residual stresses may also be caused by differences between the bulk modulus of the diamond (including PCD and TSP) and the carbide materials in a cutter. By controlling the content and amount of diamond and carbide materials in the substrate near the interface surface (i.e., in an interface region), the modulus of the substrate can be adjusted based on:

$$K_{total} = \sum_i K_i V_i$$

where $K_i$ is the bulk modulus and $V_1$ is the volume ratio of the $i^{th}$ component. By lowering the total bulk modulus in the substrate, the difference between the substrate bulk modulus and the PDC table bulk modulus may be significantly reduced, which thereby reduces the amount of residual stresses in the cutter.

The size, shape, number, etc. of diamond regions and the composition of the diamond-filler and carbide substrate material may be designed such that the total CTE of the interface region (i.e., region near the upper surface of a reduced-CTE substrate) is within a specific range. According to one embodiment of the present disclosure, the total CTE of the interface region may be within a range wherein the lower end of the range is the CTE of a TSP diamond material and the upper limit of the range is the CTE of a carbide substrate material. In other embodiments, the interface region may have a CTE gradient with values changing smoothly from the CTE of PDC to the CTE of a carbide substrate material.

Figure 2A:
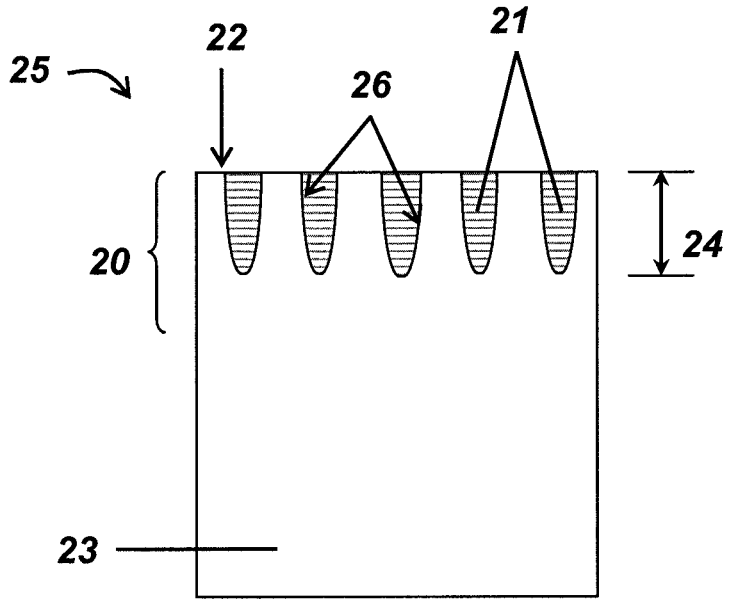
FIGS. 2A-F show cross-sectional side views of several embodiments of the present disclosure.
Figure 2B:
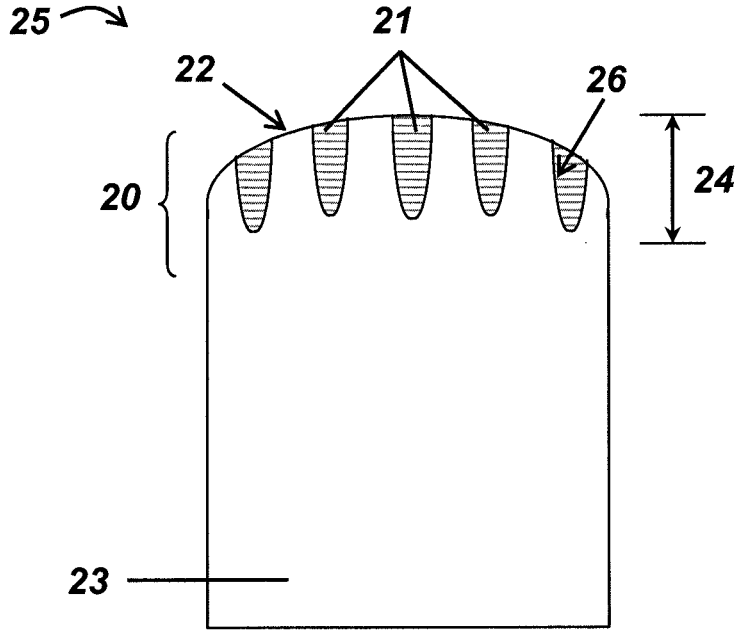
Figure 2C:
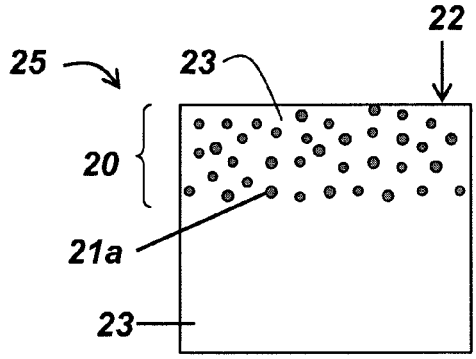
Figure 2D:
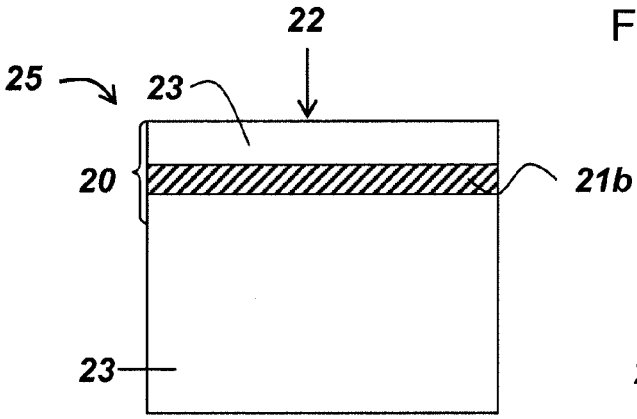
Figure 2E:
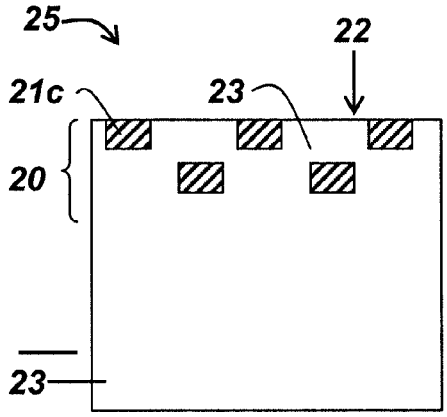
Figure 2F:
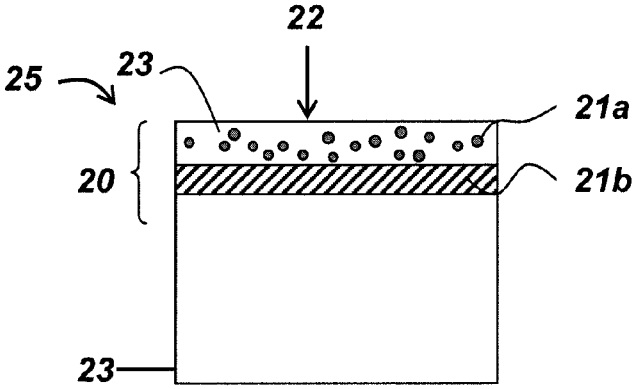

Referring to FIGS. 2A and 2B, reduced-CTE substrates 25 have an interface region 20 according to the present disclosure. Reduced CTE substrates 25 are formed from carbide substrates 23 having non-planar upper surfaces 26, wherein diamond-filler is formed in the non-planar regions (i.e., diamond-filled regions 21). The interface region 20 includes an upper composite surface 22, at least one diamond-filled region 21 extending a depth 24 into the substrate 23 from the upper composite surface 22, and a portion of the carbide substrate material extending a depth 24 into the substrate 23 from the composite surface 22. Further, in the embodiment shown, the diamond-filled regions may extend uniform or varying depths into the substrate. In embodiments having more than one diamond-filled region extending different depths into the substrate, the interface region may extend a depth into the substrate to the lowest point having diamond, or the interface region may extend a partial depth to the lowest point having diamond.

Furthermore, an upper surface of a reduced-CTE substrate may be planar, or alternatively, an upper surface may be non-planar. For example, FIG. 2A shows a reduced-CTE substrate 25 having a planar upper composite surface 22, while FIG. 2B shows a reduced-CTE substrate 25 having a non-planar upper composite surface 22. The geometry of the composite surface 22 in FIGS. 2A and 2B does not match the geometry of the non-planar surface 26 formed in the carbide substrate 23.

Figure 3A:
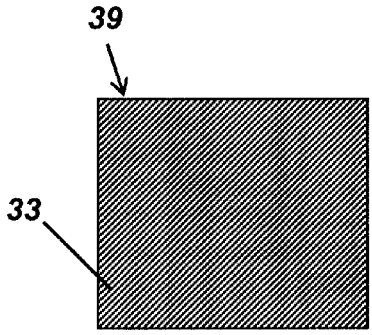
FIGS. 3A-3F show cross-sectional side views and a cross-sectional top view of various embodiments of the present disclosure.
Figure 3B:
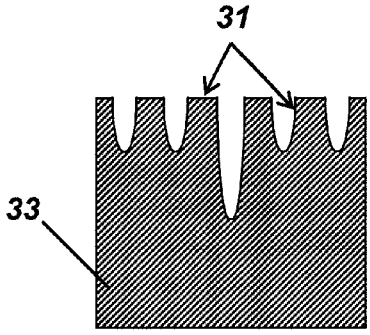
Figure 3C:
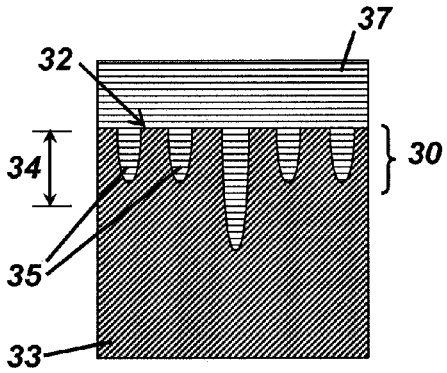
Figure 3D:
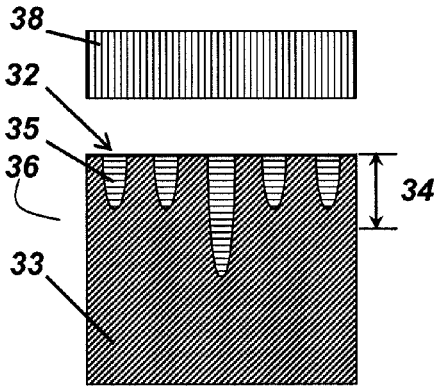
Figure 3E:
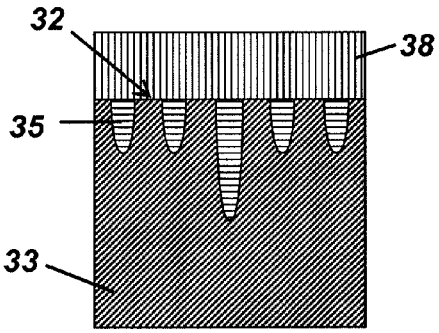
Figure 3F:
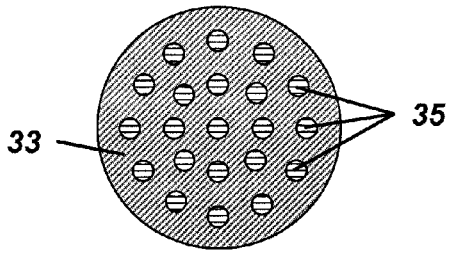

Referring now to FIGS. 3A-3F, collectively, another embodiment of a reduced-CTE substrate having a diamond/carbide upper surface and steps for forming such an embodiment are shown. In FIG. 3A, a carbide substrate 33 has an upper surface 39. In FIG. 3B, a non-planar upper surface 31 is formed from at least one non-planar region opening at the upper surface 39 of the substrate 33, wherein a centrally-positioned non-planar region extends a depth farther into the substrate 33 than a plurality of surrounding non-planar regions. As shown in FIG. 3F, the plurality of surrounding non-planar regions are arranged in a pattern having concentric circles around the centrally-positioned non-planar region. However, alternative patterns may be envisioned by one skilled in the art. For example, non-planar regions in locations other than the center of the substrate (e.g., close to the circumference of the substrate) may extend a depth farther into the substrate. Further, carbide substrates having a non-planar upper surface formed from more than one non-planar region may have different sizes of non-planar regions or uniform sizes of non-planar regions.

A carbide substrate used to form a reduced-CTE substrate may comprise a metal-carbide composite material, such as tungsten carbide and a metal binder, such as cobalt or other Group VIII metals, which may act as a solvent catalyst material to adjacent diamond material during HPHT sintering. In some embodiments, the carbide substrate may comprise pelletized diamond grits, which are formed from diamond particles uniformly encapsulated with a matrix material. Diamond particles used to form pelletized diamond grit may be natural or synthetic diamond particles and may have a particle size ranging from 200 to 18 mesh. The matrix material encapsulant layer may comprise a carbide material such as tungsten carbide or a mixture of carbide and metal particles to form a metal-carbide composite material such as tungsten carbide cobalt or tungsten carbide cobalt copper, for example.

As shown in FIG. 3C, an amount of diamond powder and a desired catalyst material are mixed and placed adjacent to the non-planar upper surface 31 of the substrate 33, which is then subjected to HPHT conditions to form PCD-filled regions 35, an interface region 30, and a PCD layer 37 adjacent to the interface region 30. Alternatively, the substrate may include a metal solvent catalyst that may be provided by infiltration to catalyze intercrystalline bonding of a diamond powder, in which case it may not be necessary to mix the diamond powder with a metal solvent catalyst prior to HPHT processing.

Figure 6A:
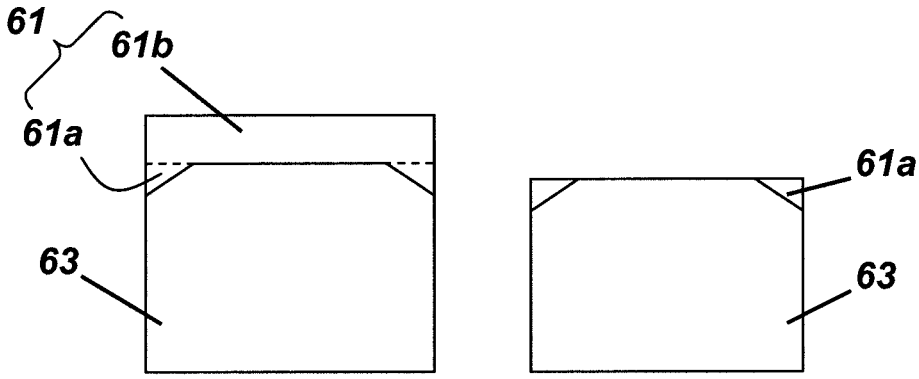
FIGS. 6A-6C show an exemplary method of forming a cutting element according to the present disclosure.

It is within the scope of this disclosure that an excess amount or a lesser amount of diamond particles may be placed adjacent the non-planar upper surface of a substrate. For example, FIG. 6A shows one embodiment having an excess amount of diamond particles 61 placed adjacent a substrate 63 and another embodiment having a lesser amount of diamond particles 62 placed adjacent a substrate 63. In embodiments having a lesser amount of diamond particles placed adjacent the non-planar upper surface of a substrate, a PCD layer may not be formed during the formation of the PCD-filled regions. Rather, the lesser amount of diamond powder may be placed along the non-planar upper surface, such that the diamond powder only fills the non-planar regions, which may then be subjected to HPHT conditions to form a composite surface.

Embodiments having a diamond layer formed during the process of forming a reduced-CTE substrate (e.g., by placing an excess amount of diamond particles adjacent to the non-planar surface of a carbide substrate) may have the diamond layer removed by cutting the reduced-CTE substrate so that at least a portion of the upper surface is formed of carbide (and having a composite surface in the embodiment shown in FIG. 3). Such PCD removal may be performed using any technique known in the art of cutting diamond including, for example, methods such as laser micro machining, ion beam milling (also referred to as ion bombardment etching), etc., and preferably by electric discharge machining (EDM). For example, referring back to FIGS. 3A-F, the excess diamond layer 37 may be removed by cutting the reduced-CTE substrate along plane 32 (to become upper surface 32) so that the upper surface includes both diamond 35 and carbide material 33. Upon removal of the excess diamond layer 37, the upper portion or interface region 30 of the reduced-CTE substrate formed possesses both diamond and carbide, to lower the effective CTE below that of the carbide material alone.

Specifically, interface region 30 is a region extending from the composite surface 32 of a carbide substrate 33 to a depth 34 into the substrate 33, and includes at least a portion of the PCD-filled regions 35 and the carbide substrate material surrounding the PCD-filled regions 35. The CTE of the interface region 30 may depend on, for example, the carbide substrate material composition, the size and number of PCD-filled regions 35, the depth 34 of the interface region, etc.

In embodiments having varying depths of diamond-filled regions, an interface region may have a gradient coefficient of thermal expansion (CTE). In particular, the portion of the interface region closer to the composite surface (which includes at least a portion of each diamond-filled region) may have a total CTE falling within a range closer to the CTE of PCD because a larger volume of PCD-filler material is present. The portion of the interface region farther from the composite upper surface (which includes only the portions of diamond-filled regions that extend deeper than the interface region close to the interface surface) may have a total CTE falling within a range closer to the CTE of the carbide substrate material because that portion includes a larger volume of carbide substrate material.

Moreover, diamond-filled regions may take any geometrical (regular or irregular) shape or form, including for example, having a generally equal or varying diameter along the length of the diamond-filled region, as well as any peaks, valleys, grooves, ridges, etc., or any other shape that may be formed in a substrate in conventional non-planar interface techniques. In embodiments having diamond-filled regions beneath the upper surface of the substrate, the diamond-filled regions may be round in shape. Additionally, as shown by comparing the general representative size of the various diamond-filled regions 35 in FIGS. 3C-3E, diamond-filled regions may be selected to have different general relative dimensions depending, for example, on the methods by which the diamond-filled regions are being formed, among other design considerations. Thus, in some embodiments, for example, one or more diamond-filled region may be selected to have a larger diameter at the intersection between the diamond-filled region and the composite surface of the carbide substrate than other diamond-filled regions within the same substrate. In particular embodiments, the diameters (or general dimension for non-circular diamond-filled regions) of the diamond-filled regions may range from millimeter scale (up to 3 mm in some embodiments) to microscale (less than 1 mm and less than 50 microns) to nanoscale (down to 100, 50, or 10 nm in various embodiments). However, one skilled in the art would appreciate that the selected size may be based on factors such as the size of the PCD body, the techniques by which the diamond-filled regions are formed, any effect on the material and mechanical properties of the PCD body, etc. It is also within the scope of the present disclosure that various combinations of type, number, shape, and size of diamond-filled regions may be made.

Additionally, there is no limit on the placement or pattern of the diamond-filled regions formed in the substrate. For example, as shown in FIG. 3F, the diamond-filled regions 35 may form a pattern of concentric circles. However, diamond-filled regions may also take any regular array of evenly spaced diamond-filled regions or the diamond-filled regions may be randomly distributed across a substrate.

Figure 4A:
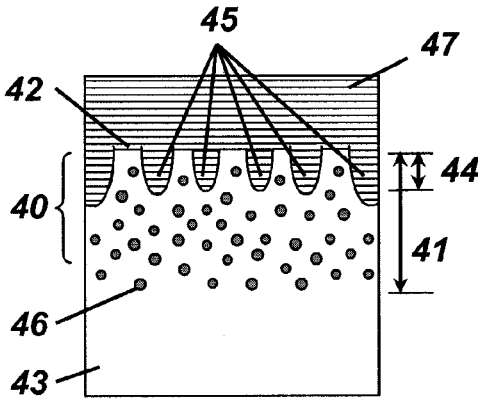
FIGS. 4A-4D show cross-sectional side views of other embodiments of the present disclosure.
Figure 4B:
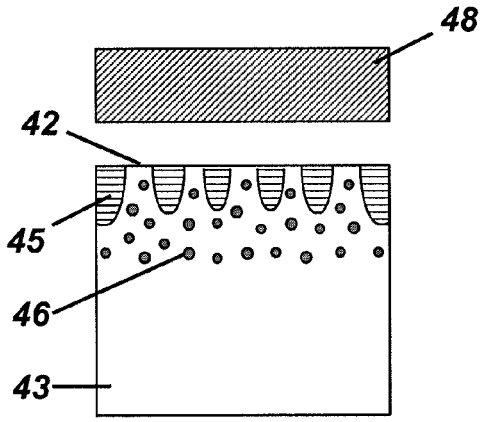

In some embodiments of the present disclosure, the total CTE of an interface region may also be controlled by embedding diamond particles within the carbide substrate. For example, referring to FIGS. 4A-4D, a carbide substrate 43 has at least one diamond-filled region 45 formed therein. Diamond-filled regions 45 extend from a composite surface 42 of the carbide substrate 43 to a depth 44 into the substrate 43 (the depth 44 of each diamond-filled region 45 may vary). The substrate 43 also comprises diamond particles 46 embedded throughout a second depth 41 into the substrate 43 from the composite surface 42. The second depth 41 may be larger or smaller than the depth 44, or alternatively, the second depth 41 may be the same as depth 44. In an exemplary embodiment, depth 44 may be about 0.1 to 0.7 times the thickness of a diamond table (which may be attached to the reduced-CTE substrate), and second depth 41 may extend the entire length of the substrate. Diamond particles 46 may comprise PCD, natural or synthetic diamond. As shown in FIG. 4A, an interface region 40 includes the composite surface 42, the diamond-filled regions 45, a portion of the diamond particles 46, and the substrate material surrounding the diamond-filled regions.

The substrate 43 may be made by mixing diamond particles into WC and Co powder to form a green body and then sintering the mixture using, for example, HPHT conditions or other traditional sintering methods for forming carbide substrates. The diamond-filled regions 45 may then be made, for example, by forming regions (e.g., cavities) in the substrate 43 during sintering or by EDM, laser cutting, or other machining methods known in the art.

Referring to FIGS. 2C-F, alternative embodiments of reduced-CTE substrates 25 having an interface region 20 according to the present disclosure are shown. Reduced-CTE substrates 25 are formed from carbide substrates 23 having diamond regions 21 incorporated therein. The interface region 20 includes an upper surface 22 of carbide 23 and at least one diamond region 21 present at some depth 24 into the substrate 23 from the upper surface 22. Various embodiments may include diamond particles 21*a* dispersed in the interface region 20 (shown in FIG. 2C), a polycrystalline diamond layer 21*b* spaced a given depth beneath the upper surface 22 within the interface region (shown in FIG. 2D), polycrystalline diamond segments 21*c* spaced a given depth beneath the upper surface within the interface region 20 (shown in FIG. 2E), or combinations thereof (such as the combination of dispersed diamond particles 21*a* and a polycrystalline diamond layer 21*b* shown in FIG. 2F). Further, similar as described with respect to FIGS. 2A-B, the diamond regions may extend to uniform or varying depths into the substrate.

Forming a Cutting Element with the Reduced-CTE Substrates

Upon formation of the reduced-CTE substrate, the reduced CTE-substrate may be used to form a polycrystalline diamond cutting element. In some embodiments, the reduced-CTE substrates may be attached to a preformed polycrystalline diamond or the polycrystalline diamond may be formed during the attachment process. Specific embodiments of the present disclosure include (1) attachment of a preformed polycrystalline diamond body to a reduced-CTE substrate having a diamond/carbide composite upper surface; (2) formation of a polycrystalline diamond layer simultaneous with the attachment to a reduced-CTE substrate having a diamond/carbide composite upper surface; (3) attachment of a preformed polycrystalline diamond body to a reduced-CTE substrate having a carbide-only upper surface and diamond spaced a depth rearwardly therefrom; (4) formation of a polycrystalline diamond layer simultaneous with the attachment to a reduced-CTE substrate having a carbide-only upper surface and diamond spaced a depth rearwardly therefrom; (5) attachment of a preformed polycrystalline diamond body to a reduced-CTE substrate having partial diamond, partial carbide; and (6) formation of a polycrystalline diamond layer simultaneous with the attachment to a reduced-CTE substrate having partial diamond, partial carbide. Additionally, when pre-formed PCD bodies are used, such bodies may include conventional PCD, high density PCD, TSP, or non-conventional PCD having a thermally stable secondary phase.

Forming Polycrystalline Abrasive Bodies

A polycrystalline diamond (PCD) body may be formed in a conventional manner, such as by sintering "green" diamond particles to create intercrystalline bonding between the particles. "Sintering" may involve a high pressure, high temperature (HPHT) process. Examples of HPHT processes can be found, for example, in U.S. Pat. Nos. 4,694,918; 5,370,195; and 4,525,178. Briefly, to form the polycrystalline diamond object, an unsintered mass of diamond crystalline particles is placed within a metal enclosure of the reaction cell of a HPHT apparatus. A suitable HPHT apparatus for this process is described in U.S. Pat. Nos. 2,947,611; 2,941,241; 2,941,248; 3,609,818; 3,767,371; 4,289,503; 4,673,414; and 4,954,139. A metal catalyst, such as cobalt or other Group VIII metals, may be included with the unsintered mass of crystalline particles to promote intercrystalline diamond-to-diamond bonding. The catalyst material may be provided in the form of powder and mixed with the diamond grains, or may be infiltrated into the diamond grains during HPHT sintering. An exemplary minimum temperature is about 1200° C. and an exemplary minimum pressure is about 35 kilobars. Typical processing is at a pressure of about 45 kbar and a temperature of about 1300° C. Those of ordinary skill will appreciate that a variety of temperatures and pressures may be used, and the scope of the present invention is not limited to specifically referenced temperatures and pressures.

Diamond grains useful for forming a polycrystalline diamond body may include any type of diamond particle, including natural or synthetic diamond powders having a wide range of grain sizes. For example, such diamond powders may have an average grain size in the range from submicrometer in size to 100 micrometers, and from 1 to 80 micrometers in other embodiments. Further, one skilled in the art would appreciate that the diamond powder may include grains having a mono- or multi-modal distribution.

Moreover, the diamond powder used to prepare the PCD body may be synthetic diamond powder or natural diamond powder. Synthetic diamond powder is known to include small amounts of solvent metal catalyst material and other materials entrained within the diamond crystals themselves. Unlike synthetic diamond powder, natural diamond powder does not include such solvent metal catalyst material and other materials entrained within the diamond crystals. It is theorized that the inclusion of materials other than the solvent catalyst in the synthetic diamond powder can operate to impair or limit the extent to which the resulting PCD body can be rendered thermally stable, as these materials along with the solvent catalyst must also be removed or otherwise neutralized. Because natural diamond is largely devoid of these other materials, such materials do not have to be removed from the PCD body and a higher degree of thermal stability may thus be obtained. Accordingly, for applications calling for a particularly high degree of thermal stability, one skilled in the art would appreciate that the use of natural diamond for forming the PCD body may be preferred.

The diamond grain powder, whether synthetic or natural, may be combined with or already include a desired amount of catalyst material to facilitate desired intercrystalline diamond bonding during HPHT processing. Suitable catalyst materials useful for forming the PCD body include those solvent metals selected from the Group VIII of the Periodic table, with cobalt (Co) being the most common, and mixtures or alloys of two or more of these materials. In a particular embodiment, the diamond grain powder and catalyst material mixture may comprise 85 to 95% by volume diamond grain powder and the remaining amount catalyst material. Alternatively, the diamond grain powder can be used without adding a solvent metal catalyst in applications where the solvent metal catalyst can be provided by infiltration during HPHT processing from the adjacent substrate or adjacent other body to be bonded to the PCD body.

The diamond powder may be combined with the desired catalyst material in a reaction cell, which is then placed under processing conditions sufficient to cause the intercrystalline bonding between the diamond particles. In the event that the formation of a PCD compact comprising a substrate bonded to the PCD body is desired, a selected substrate is loaded into the container adjacent the diamond powder mixture prior to HPHT processing. Additionally, in the event that the PCD body is to be bonded to a substrate, and the substrate includes a metal solvent catalyst, the metal solvent catalyst needed for catalyzing intercrystalline bonding of the diamond may be provided by infiltration, in which case it may not be necessary to mix the diamond powder with a metal solvent catalyst prior to HPHT processing.

In an example embodiment, a reaction cell may be controlled so that the container is subjected to a HPHT process comprising a pressure in the range of from 5 to 7 GPa and a temperature in the range of from about 1320 to 1600° C., for a sufficient period of time. During this HPHT process, the catalyst material in the mixture melts and infiltrates the diamond grain powder to facilitate intercrystalline diamond bonding. During the formation of such intercrystalline diamond bonding, the catalyst material may migrate into the interstitial regions within the microstructure of the so-formed PCD body that exists between the diamond bonded grains It should be noted that if too much additional non-diamond material is present in the powdered mass of crystalline particles, appreciable intercrystalline bonding is prevented during the sintering process. Such a sintered material where appreciable intercrystalline bonding has not occurred is not within the definition of PCD. Following such formation of intercrystalline bonding, a PCD body may be formed that has, in one embodiment, at least about 80 percent by volume diamond, with the remaining balance of the interstitial regions between the diamond grains occupied by the catalyst material. In other embodiments, such diamond content may comprise at least 85 percent by volume of the formed diamond body, and at least 90 percent by volume in yet another embodiment. However, one skilled in the art would appreciate that other diamond densities may be used in alternative embodiments. Thus, the PCD bodies being used in accordance with the present disclosure include what is frequently referred to in the art as "high density" PCD.

Further, in some embodiments of the present disclosure, PCD may be formed by ultra-high pressure sintering. Ultra-high pressure sintering may be conducted at, for example, temperatures ranging from 1400° C. to 1600° C. and pressures of greater than 80 kbar. Embodiments using ultra-high pressure sintering to form PCD may involve, for example, first forming a reduced-CTE substrate through methods described herein. Diamond particles may then be placed on the composite surface of the reduced-CTE substrate, and sintered together under ultra-high pressures to form a high density PCD layer attached to the reduced-CTE substrate. Ultra-high pressure sintering may require less catalyst material for diamond to diamond bonding (PCD formation) to occur than the amount typically required for conventional HPHT sintering. Thus, a denser diamond may be formed using ultra-high pressures. Generally, such ultra-high pressures cannot be used with a conventional substrate due to the CTE and modulus differential, which cause cracking in the layer. However, use of a reduced-CTE substrate may reduce the differential, residual stresses, and likelihood of cracking, making the ultra-high pressures realistic as sintering conditions. In other embodiments, ultra-high pressure sintering may be used to sinter a TSP diamond layer to a reduced-CTE substrate. Under ultra-high pressure sintering, TSP expansion from bulk modulus may increase, which may offset a greater thermal expansion difference (between TSP and carbide) and reduce total residual stress.

Thus, these methods for forming a polycrystalline diamond abrasive body may be used to form such body prior to attachment to the reduced-CTE substrate, or alternatively, the methods may be used to form the body during attachment to the reduced-CTE substrate. Further, depending on the type and size of the polycrystalline diamond body, the substrate and interface region may be formed to have a specifically designed coefficient of thermal expansion such that residual stresses are minimized within the cutting element.

In embodiments where a preformed diamond body is attached to the reduced-CTE substrate, the attachment step is a second sintering step, wherein a first sintering step was used to form the diamond body. Methods of attaching or reattaching a diamond layer to a reduced-CTE substrate may include HPHT sintering, such as discussed above and in U.S. Patent Publication No. 2009/0313908, which is assigned to the present assignee and which is incorporated herein by reference, or by an ultra high pressure sintering process. In a particular embodiment, the preformed diamond body is formed by forming a polycrystalline diamond layer attached to a substrate and then removing the polycrystalline diamond layer from the substrate. In this instance, the substrate that was initially used to form the diamond body may be the same or a different substrate than was used to form the reduced-CTE substrate. In a specific embodiment, referring back to FIGS. 3A-F, a polycrystalline diamond layer 37 is cut along selected surface 32 (which becomes upper surface 32) to form reduced-CTE substrate 36. In the embodiment shown in FIG. 3D, a reduced-CTE substrate 36 is then sintered to a leached diamond body 38; however, it is also within the scope of the present disclosure that an unleached diamond body may be sintered to the reduced-CTE substrate 36.

However, the attachment of a leached diamond body 38 (discussed in greater details below), i.e., a network of diamond particles bonded together being substantially free of metal in the interstitial spaces (metal solvent catalyst or otherwise), to a reduced-CTE substrate may result in the migration of an infiltrant material, the source of which may be the substrate and/or an intermediate material (e.g., diamond filler material, or a powder mixture), into the diamond body. In a particular embodiment, for example, the source of infiltrant material may be the reduced-CTE during the HPHT sintering/attachment process. In another embodiment, the source of infiltrant material may be an intermediate material placed between a reduced CTE substrate and a TSP layer prior to attachment.

As used herein, the term "infiltrant material" is understood to refer to materials that are other than the catalyst material used to initially form the diamond body, and can include materials identified in Group VIII of the periodic table that have subsequently been introduced into the already formed diamond body. The term "infiltrant material" is not intended to be limiting on the particular method or technique used to introduce such material into the already formed diamond body.

In a preferred embodiment, the PCD layers 37 removed during the formation of the reduced-CTE substrate 36 may be treated to remove the catalyst material initially used to form the polycrystalline bonds in the PCD layer 37. Upon treatment, the resulting TSP diamond body 38 may then be attached to a reduced-CTE substrate (the same or different one) using an HPHT process for a period of time and at a temperature sufficient to meet the melting point of an infiltrant material present in the substrate such that the infiltrant material migrates to the TSP body.

Figure 4C:
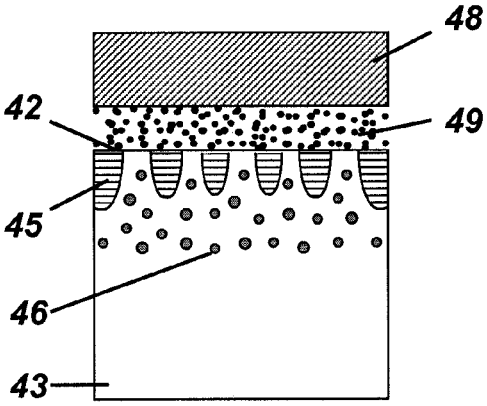

Further, according to some embodiments of the present disclosure, an intermediate material may be placed between a reduced CTE substrate and a diamond layer prior to attachment (or reattachment) of the diamond layer to the substrate to act as a sintering aid and/or a transition layer. For example, as shown in FIG. 4C, a TSP layer 48 (or non-leached PCD) may be reattached to a reduced CTE substrate 43 by placing an intermediate material 49 between the TSP layer 48 and the composite surface 42 of the substrate 43. The intermediate material 49 may include, for example, diamond powder, carbide powders, such as tungsten carbide, metals, and combinations thereof.

Figure 4D:
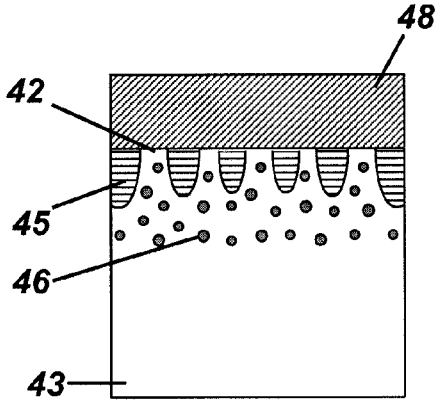
Figure 5A:
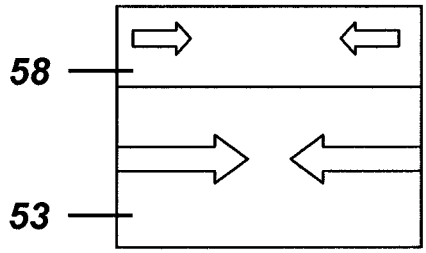
FIGS. 5A-5C show stress effects conventionally found in a PDC cutter.
Figure 5B:
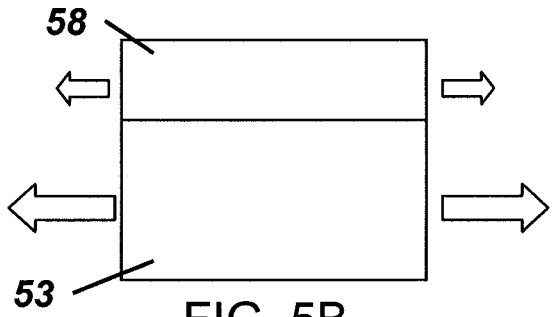
Figure 5C:
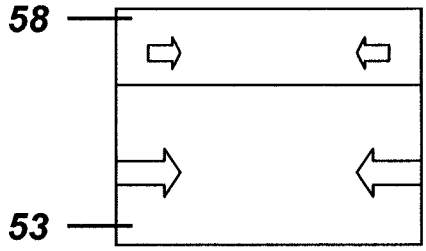

The reduced-CTE substrate 43, intermediate material 49, and the TSP layer 48 may then be subjected to HPHT conditions, for example, to form a cutter having reduced residual stresses, as shown in FIG. 4D. However, in some embodiments, due to the stresses that may result from the HPHT conditions during the attachment (or reattachment), the preformed diamond body to be attached to a reduced-CTE substrate may have a minimum thickness of approximately 1.0 mm (at its thinnest part) such that it may withstand being subjected to the second application of HPHT conditions without cracking.

Various embodiments discussed above refer to a leached diamond body or TSP. In such embodiments, a formed PCD body (either attached or unattached to a substrate) having a catalyst or other metal material in the interstitial spaces between bonded diamond grains may be subjected to a leaching process, whereby the catalyst or other metal material is removed from the PCD body. As used herein, the term "removed" refers to the reduced presence of catalyst or metal material in the PCD body, and is understood to mean that a substantial portion of the catalyst or metal material no longer resides in the PCD body. However, one skilled in the art would appreciate that trace amounts of catalyst material may still remain in the microstructure of the PCD body within the interstitial regions and/or adhered to the surface of the diamond grains.

Alternatively, rather than actually removing the catalyst material from the PCD body or compact, the selected region of the PCD body or compact may be rendered thermally stable by treating the catalyst material in a manner that reduces or eliminates the potential for the catalyst material to adversely impact the intercrystalline bonded diamond at elevated temperatures. For example, the catalyst material may be combined chemically with another material to cause it to no longer act as a catalyst material, or may be transformed into another material that again causes it to no longer act as a catalyst material. Accordingly, as used herein, the terms "removing substantially all" or "substantially free" as used in reference to the catalyst material is intended to cover the different methods in which the catalyst material may be treated to no longer adversely impact the intercrystalline diamond in the PCD body or compact with increasing temperature.

In a particular embodiment, the PCD body may be formed using solvent catalyst material from a substrate, for example, a WC—Co substrate, during the HPHT process. In such embodiments where the PCD body is formed with a preformed substrate, the PCD layer may be detached or removed from the substrate prior to leaching so that leaching agents may attack the diamond body in an unshielded manner, i.e., from all sides of the diamond body without substantial restriction.

The quantity of the catalyst material remaining in the PCD microstructure after the PCD body has been subjected to a leaching treatment may vary, for example, on factors such as the treatment conditions, including treatment time. Further, one skilled in the art would appreciate that it may be desired in certain applications to allow a small amount of catalyst material to stay in the PCD body. In a particular embodiment, the PCD body may include up to 1-2 percent by weight of the catalyst material. However, one skilled in the art would appreciate that the amount of residual catalyst present in a leached PCD body may depend on the diamond density of the material, and body thickness.

A conventional leaching process involves the exposure of an object to be leached with a leaching agent. In select embodiments, the leaching agent may be a weak, strong, or mixtures of acids. In other embodiments, the leaching agent may be a caustic material such as NaOH or KOH. Suitable acids may include, for example, nitric acid, hydrofluoric acid, hydrochloric acid, sulfuric acid, phosphoric acid, or perchloric acid, or combinations of these acids. In addition, caustics, such as sodium hydroxide and potassium hydroxide, have been used in the carbide industry to digest metallic elements from carbide composites. Moreover, other acidic and basic leaching agents may be used as desired. Those having ordinary skill in the art will appreciate that the molarity of the leaching agent may be adjusted depending on the time desired to leach, concerns about hazards, etc.

Further, in such an embodiment where the PCD body is treated after attachment to the reduced-CTE substrate, the metal material removed from the interstitial spaces may be the infiltrant material. Techniques useful for removing a portion of the infiltrant material from the diamond compact include the same techniques described above for removing the catalyst material used to initially form the diamond compact from the polycrystalline diamond body, e.g., such as by leaching or the like. Depending on the application, it may be desired that the process of removing the infiltrant material be controlled so that the infiltrant material be removed from a targeted region of the diamond compact extending a determined depth from one or more diamond compact surfaces. These surfaces may include working and/or nonworking surfaces of the diamond compact.

Treating the compact to remove such infiltrant material may render the polycrystalline diamond body or compact thermally stable by treating the infiltrant material in a manner that reduces or eliminates the potential for the infiltrant material to adversely impact the intercrystalline bonded diamond at elevated temperatures. Generally, some infiltrant materials, like catalyst materials may be problematic when heat is generated at the cutter impact point of the compact. Specifically, heat generated at the exposed part of the polycrystalline diamond body, caused by friction between the polycrystalline diamond and the work material, may result in thermal damage to the polycrystalline diamond in the form of cracks (due to differences in thermal expansion coefficients) which may lead to spalling of the polycrystalline diamond layer, delamination between the polycrystalline diamond and the substrate, and back conversion of diamond to graphite causing rapid abrasive wear. Thus, increased thermal stability may be achieved by treating the compact to remove such infiltrant material using such methods as leaching or other methods known in the art.

Alternatively, an intermediate material may used as a barrier to prevent or minimize the migration of infiltrant material from Group VIII of the Periodic Table into a polycrystalline diamond layer during attachment or reattachment to a reduced-CTE substrate, such as described in U.S. Patent Application Publication Nos. 2008-0230280 and 2008-0223623, which are hereby incorporated by reference. By controlling the migration of infiltrant material into the polycrystalline diamond layer, an additional step of treating the compact to remove infiltrant material using such methods as leaching may not be necessary.

Referring back to FIGS. 3A-F, a carbide substrate 33 has a non-planar surface 31 formed therein. Diamond powder, and optionally a desired catalyst material, is placed adjacent to the non-planar surface 31 of the substrate 33, which is then subjected to HPHT conditions to form PCD-filled regions 35, a composite surface 32, and a PCD layer 37 adjacent to the composite surface 32. Composite surface 32 is formed of both diamond and carbide. The PCD layer 37 is removed from the cutter at the composite surface 32 and leached to form a TSP layer 38. Removal of the PCD layer 37 also forms a reduced-CTE substrate. Leaching removes at least a substantial portion of the catalyzing material from the interstitial regions of PCD, leaving voids (other than the non-planar regions) dispersed in the diamond matrix or regions that were previously occupied by catalyzing material. Upon leaching, the TSP layer 38 is then attached to the reduced-CTE substrate 36 (the same or different one) along its upper surface 32. The resulting product is a cutting element having reduced residual stresses therein (including in the polycrystalline diamond layer and along the interface). Additionally, when the upper surface of the reduced-CTE substrate (as shown in FIGS. 3A-F) is formed of both diamond and carbide, the attachment of the diamond layer to the substrate having diamond along a portion of its upper surface results in a cutting element having a non-planar interface between the carbide and diamond. Depending on the conditions, in addition to infiltrant material sweeping through diamond regions 35 to migrate into TSP layer 38 (or a PCD layer), diamond-to-diamond bond between the PCD regions 35 and the TSP layer 38 may also occur. Depending on the types of diamond used to form the PCD regions, the types of diamond used to form the PCD layer on the final cutting element (diamond powder vs. polycrystalline diamond body (leached or unleached), diamond grain size of each, sintering conditions), the PCD regions 35 may be indistinguishable from the upper layer or not. In some embodiments, the PCD regions from the reduced-CTE substrate may be distinguishable from the diamond layer formed thereon by virtue of a difference in diamond density and/or diamond grain sizes therebetween.

EXAMPLES

Figure 6B:
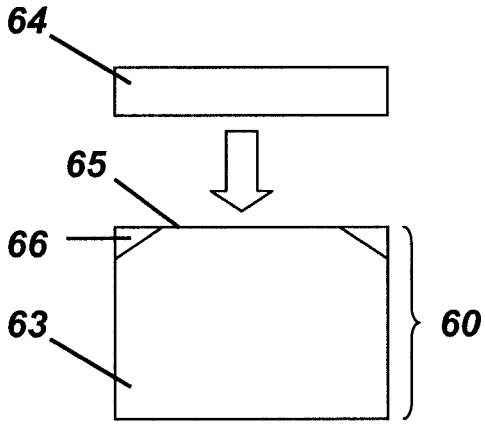
Figure 6C:
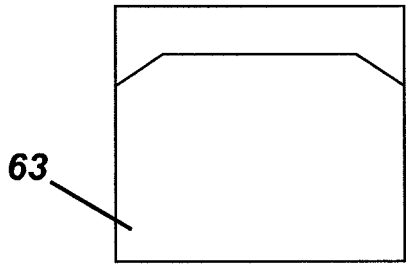

In an exemplary embodiment, as shown in FIGS. 6A-C, non-planar regions are formed in the upper surface of a carbide substrate 63 (along the outer diameter of the substrate in this embodiment). An excess amount of a mixture of diamond particles and optional catalyst material 61 (61*a* being the diamond particles that "fill" the non-planar geometry of the substrate 63 and 61*b* being the "excess" diamond particles) may be placed adjacent to the non-planar upper surface such that the mixture 61*b* extends a distance above the carbide substrate upper surface. The mixture 61 and the substrate 63 are then subjected to a HPHT sintering process, whereby PCD-filled regions 66 and a PCD layer (from excess mixture 61*b*) are formed. The PCD layer is then removed, leaving a reduced-CTE substrate 60. The removed PCD layer is then leached to form a TSP diamond layer 64, and reattached to the reduced-CTE substrate 60 by HPHT sintering.

Alternatively, a lesser amount of diamond particles 61*a* may be placed adjacent to the non-planar upper surface of the substrate 63, such that the diamond particles fill the non-planar regions. The diamond particles 61*a* and the substrate 63 are then subjected to a HPHT sintering process, wherein the carbide substrate 63 provides a catalyst material to create PCD-filled regions 66. The carbide substrate 63 and PCD-filled regions form a reduced-CTE substrate 60. Once a reduced-CTE substrate 60 is formed, a TSP diamond layer 64 may be attached to the composite surface 65 of the reduced-CTE substrate 60. The TSP diamond layer 64 may be attached by HPHT sintering.

Figure 7A:
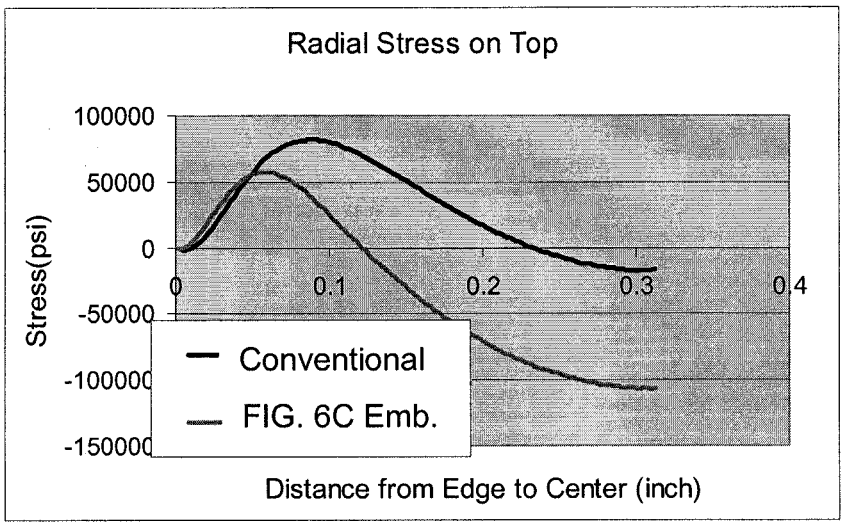
FIGS. 7A-7B show stress analyses performed on two cutting elements.
Figure 7B:
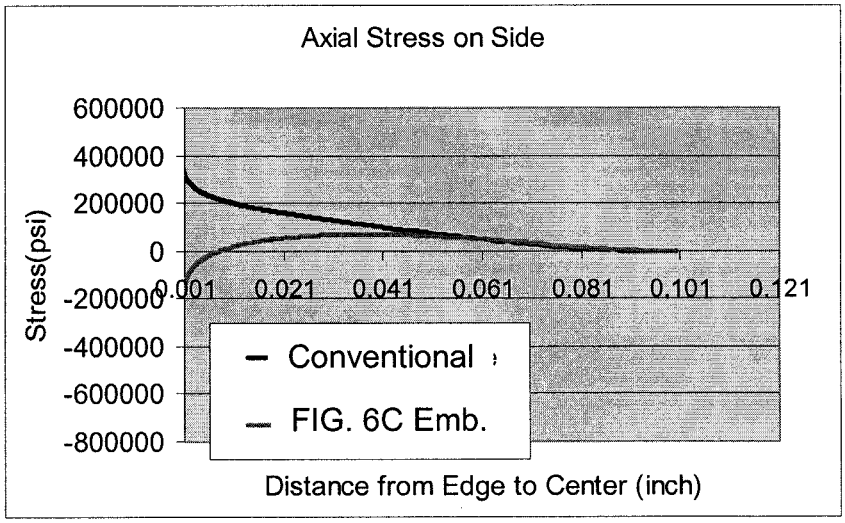

A residual stress analysis was performed on such a cutting element (shown in FIG. 6C) as well as on a cutting element formed by attaching a conventional TSP body to a conventional substrate. The results of the stress analyses are shown in FIGS. 7A-B. Specifically, as shown, the tensile radial stress (FIG. 7A) on top is significantly reduced, and a greater amount of the top surface area is under beneficial compressive stress. The tensile axial residual stress (FIG. 7B) shifts to compressive residual stress on the OD near the interface as compared to tensile residual stress, which is helpful to suppress crack initiation on the outer diameter. The residual stress analysis was performed using finite element analysis, wherein the CTE of PDC was set to $2.0\times10^{-6}$ m/m-° C. and the CTE of carbide was set to $5.0\times10^{-6}$ m/m-° C., and the residual stress was calculated by cooling down a 16 mm by 13 mm cutter from 500° C.

Figure 8A:
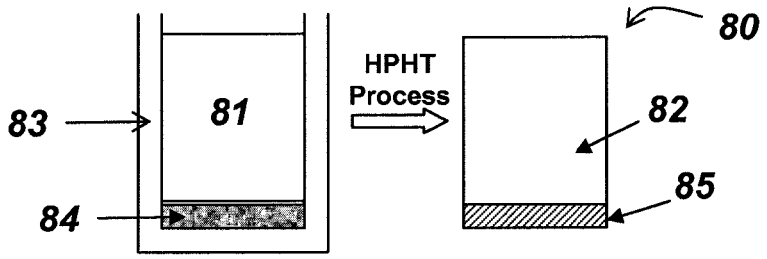
FIGS. 8A-8D show exemplary methods of forming a cutting element according to the present disclosure.
Figure 8B:
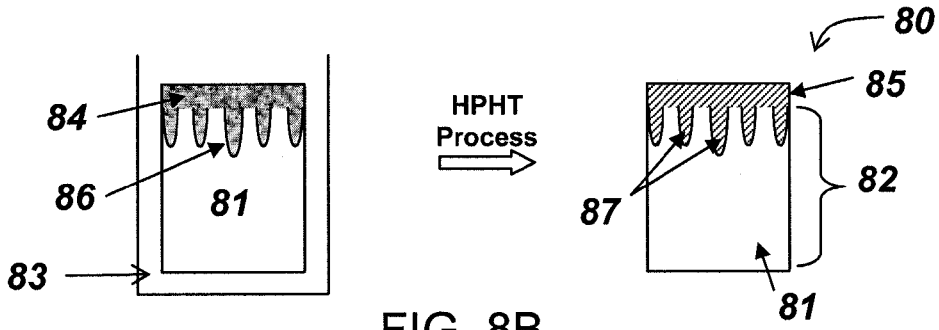

In other exemplary embodiments, as shown in FIGS. 8A-D, pelletized diamond grits are used to form a cutting element having a reduced-CTE substrate and a diamond table. In FIG. 8A, a GHI (grit hot-pressed insert) 81, formed from hot-pressing pelletized diamond grits, is placed in a canister 83 proximate to a layer of diamond powder 84 and subjected to HPHT processing to form a cutting element 80 comprising a reduced-CTE substrate 82 and a diamond cutting table 85. Alternatively, as shown in FIG. 8B, a GHI 81 having a non-planar surface 86 may be placed in a canister 83 proximate to a layer of diamond powder 84 and subjected to HPHT processing to form a cutting element 80 comprising a diamond cutting table 85 and a reduced-CTE substrate 82. The reduced-CTE substrate 82 comprises diamond-filled regions 87 within the GHI 81. The non-planar surface 86 of the GHI 81 may be formed, for example, by hot-pressing pelletized diamond grits with a non-flat bottom plunger (not shown).

Figure 8C:
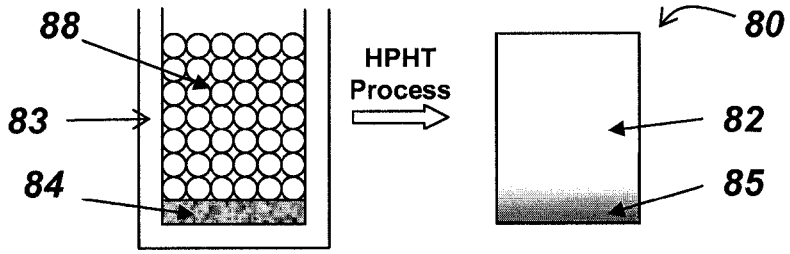
Figure 8D:
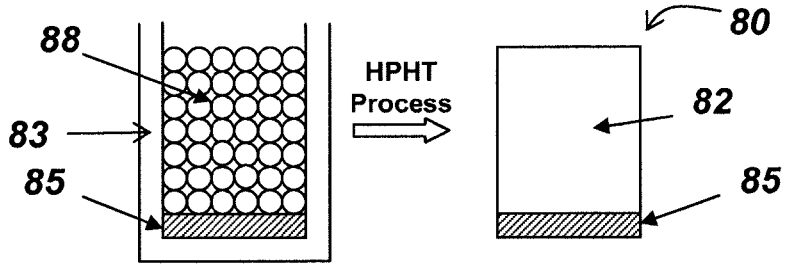

In FIG. 8C, pelletized diamond grits 88 are placed in a canister 83 next to a layer of diamond powder 84 and subjected to HPHT processing to form a cutting element 80 comprising a reduced-CTE substrate 82 and a diamond cutting table 85. Alternatively, as shown in FIG. 8D, pelletized diamond grits 88 may be placed in a canister 83 next to an already formed diamond table 85 and subjected to HPHT processing to form a cutting element 80 comprising a reduced-CTE substrate 82 and a diamond cutting table 85.

The encapsulant layer around each diamond particle in pelletized diamond grits provide spacing between the diamond particles so they do not touch each other, thus preventing micro cracking/chipping during HPHT processing. Advantageously, HPHT processing allows for a stronger bond between the diamond table and the reduced-CTE substrate (formed from pelletized diamond grits) and prevents diamond grits in the substrate from degradation. Further, HPHT processing creates harder and more abrasive resistance material for the substrate when compared to substrates made by hot pressing. HPHT processing may be conducted using a belt press or a cubic press, for example.

Embodiments of the present disclosure may provide for at least one of the following advantages. The use of the reduced-CTE substrates may provide for reduced residual tensile stresses in the diamond body of a cutting element, in particular at the top surface and along the side surface near the interface, which may result in reduced cracking and spalling of the diamond body. In the embodiment where the upper surface of the substrate is formed from both diamond and carbide, the resulting cutting element may have a non-planar interface between diamond and carbide, in addition to possessing reduced stresses. The non-planar interface provides an increase in the total surface area of diamond-substrate contact, which may provide a better grip of the diamond to the substrate.

Further, by having diamond formed in an interface region of a substrate (either embedded as particles within the substrate, as diamond-filler, or a combination of both) prior to attaching or reattaching a diamond layer to the substrate, the substrate may undergo less shrinkage during heating and cooling processes. Specifically, when polycrystalline diamond is formed adjacent to, or attached to a substrate under conventional sintering conditions, differences in the coefficient of thermal expansion between the diamond and the substrate may create residual stresses within the cutter. A PCD cutting layer formed on a substrate having diamond particles embedded therein, diamond-filled regions, or both may be removed and leached to form a TSP diamond layer. The TSP diamond layer may then be reattached to the substrate under a second sintering process. Thus, a unique gradient made of diamond particles and diamond-filled regions may be created between a TSP diamond cutting layer and a substrate of a PDC cutter.

Advantageously, using a reduced-CTE substrate to form a unique CTE gradient eliminates the contractions that occur in conventionally formed gradients (i.e., gradients formed by sintering layers of varying mixtures of diamond and carbide powder); reduces the probability of cracking when reattaching a pre-formed PDC body; allows for a more gradual change in the CTE over a longer length of the substrate; and allows for a higher sintering pressure to be achieved using the same sintering equipment and sintering cell.

A reduced-CTE substrate may also have increased erosion resistance. For example, diamond regions may be positioned within a carbide substrate such that the diamond regions have controlled exposure to the surface of the cutting element to improve erosion resistance. For example, in embodiments having substrates formed from pelletized diamond grits, diamond particles dispersed within the substrate are exposed once the diamond cutting table wears away, wherein the substrate can then act as a cutting element. Diamond grits exposed in a substrate may also act as a bearing surface, thereby further improving erosion resistance of the substrate surface. In embodiments having cutting elements brazed to a drill bit, controlled exposure of diamond regions to the surface of the cutting elements may ensure sufficient brazing strength.

Additionally, embodiments of the present disclosure may also allow for a high-density diamond layer to be formed on a cutter substrate using ultra-high pressure sintering, which requires using less catalyst material to form diamond material. Specifically, forming high-density diamond layers on a cutter substrate using ultra-high pressure sintering was previously not achievable due to the large difference in the CTE and modulus of the high-density diamond layer and the substrate. However, the present disclosure includes forming a reduced CTE substrate having an interface region with a lower CTE and higher modulus, and forming a high-density PCD layer on the substrate using ultra-high pressure sintering, such that the CTE and modulus of the interface region is closer to the CTE and modulus of the diamond layer.

Further, by having polycrystalline diamond formed in non-planar regions of a substrate prior to attaching a diamond layer to the substrate, a higher volume percent diamond is present than if, for example, carbon is infiltrated in a substrate that undergoes HPHT processing to form a diamond gradient in the substrate.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of forming a cutting element, comprising:

filling at least one non-planar region on an upper surface of a carbide substrate with a diamond mixture comprising diamond particles;

subjecting the substrate and the diamond mixture to high pressure high temperature sintering conditions to form a reduced-CTE substrate having polycrystalline diamond that extends a depth into the reduced-CTE substrate in an interface region, and an upper surface that comprises a composite surface of diamond and carbide; and attaching a polycrystalline diamond body to the composite surface of the reduced-CTE substrate by high pressure high temperature sintering.

2. The method of claim 1, further comprising:

forming the carbide substrate with the non-planar upper surface.

3. The method of claim 2, wherein during the step of forming the substrate, a plurality of diamond particles are embedded in a portion of the substrate extending a depth from the non-planar upper surface.

4. The method of claim 1, wherein the filling further comprises placing excess of the diamond mixture on the upper surface of the carbide substrate, and wherein the subjecting also forms a polycrystalline diamond layer adjacent the upper surface of the carbide substrate.

5. The method of claim 4, further comprising:

detaching the polycrystalline diamond layer from the reduced-CTE substrate.

6. The method of claim 5, further comprising:

contacting the detached polycrystalline diamond layer with a leaching agent to form a thermally stable polycrystalline diamond layer, wherein the thermally stable polycrystalline diamond layer is the polycrystalline diamond body attached to the composite surface of the reduced-CTE substrate.

7. The method of claim 1, wherein the carbide substrate comprises tungsten carbide and one or more of the metals in Group VIII of the Periodic Table.

8. The method of claim 7, wherein during the step of subjecting, the one or more metals is provided to the diamond mixture as a catalyst material by infiltration from the substrate.

9. The method of claim 1, wherein the carbide substrate comprises pelletized diamond grits, and wherein each pelletized diamond grit comprises diamond particles uniformly encapsulated with a matrix material.

10. The method of claim 9, wherein the diamond particles forming the pelletized diamond grits have sizes in the range of 200 to 18 mesh.

11. The method of claim 9, wherein the diamond particles forming the pelletized diamond grits are selected from natural diamond or synthetic diamond.

12. The method of claim 11, wherein the matrix material comprises tungsten carbide and a metal binder.

13. The method of claim 1, wherein the polycrystalline diamond body attached to the composite surface of the reduced-CTE substrate is a thermally stable polycrystalline diamond layer.

14. The method of claim 13, wherein during the step of attaching, a metal from the reduced-CTE substrate at least partially migrates into the thermally stable polycrystalline diamond layer.

15. The method of claim 13, wherein during attaching the thermally stable polycrystalline diamond layer, an intermediate material is provided between the composite surface and the thermally stable polycrystalline diamond layer.

16. The method of claim 13, wherein the intermediate material comprises at least one of diamond powder, tungsten carbide powder, or metal powder.

17. The method of claim 1, wherein the diamond mixture further comprises a catalyst material.

18. The method of claim 1, wherein a size of the at least one non-planar region is selected such that the interface region has a total coefficient of thermal expansion based on the equation:

$$\alpha_{total} = \sum_i \alpha_i V_i$$

wherein $\alpha_{total}$ is the total coefficient of thermal expansion, $\alpha_i$ is a coefficient of thermal expansion of an $i^{th}$ component, and $V_i$ is the volume fraction of the $i^{th}$ component; and wherein the $i^{th}$ component comprises the carbide within the interface region and the polycrystalline diamond within the interface region.

19. The method of claim 1, further comprising removing metal from the interstitial spaces in the polycrystalline diamond body after it is attached to the reduced-CTE substrate at a selected depth from an outer surface of the polycrystalline diamond body.

20. The method of claim 1, wherein the attaching a polycrystalline diamond body to the composite surface comprises placing a plurality of diamond particles adjacent the composite surface and subjecting the reduced-CTE substrate and the diamond particles to high pressure high temperature sintering conditions to form the polycrystalline diamond body attached to the reduced-CTE substrate.

21. A method of forming a cutting element, comprising:

providing a plurality of carbide particles and a plurality of diamond particles;

sintering the plurality of carbide particles and the plurality of diamond particles to form a reduced-CTE substrate having an upper surface at least partially formed from carbide; and attaching a polycrystalline diamond body to the upper surface of the reduced-CTE substrate by high pressure high temperature sintering.

22. The method of claim 21, wherein the plurality of carbide particles and the plurality of diamond particles are provided such that the diamond particles are distributed in the mixture of carbide particles in an interface region of the substrate.

23. The mixture of claim 21, wherein the plurality of diamond particles are provided as a layer of particles between two layers of carbide particles.

24. The mixture of claim 21, wherein the plurality of diamond particles are provided in the form of at least one segment of polycrystalline diamond.

25. The method of claim 24, wherein the at least one segment of polycrystalline diamond is spaced a selected distance from the upper surface.

26. The method of claim 24, wherein the at least one segment of polycrystalline diamond is placed so that a portion of the at least one segment of polycrystalline diamond aligns with the upper surface.

27. The method of claim 21, wherein the plurality of carbide particles and the plurality of diamond particles are provided in the form of pelletized diamond grit, wherein each diamond particle is uniformly encapsulated with a matrix material comprising the carbide particles.

28. The method of claim 21, wherein the polycrystalline diamond body attached to the upper surface of the reduced-CTE substrate is thermally stable polycrystalline diamond layer.

29. The method of claim 28, wherein during the step of attaching, a metal from the reduced-CTE substrate at least partially migrates into the thermally stable polycrystalline diamond layer.

30. The method of claim 28, wherein during attaching the thermally stable polycrystalline diamond layer, an intermediate material is provided between the upper surface and the thermally stable polycrystalline diamond layer.

31. The method of claim 30, wherein the intermediate material comprises at least one of diamond powder, tungsten carbide powder, or metal powder.

32. The method of claim 21, during providing a plurality of carbide particles and a plurality of diamond particles, further providing one or more of the metals in Group VIII of the Periodic Table.

33. The method of claim 21, wherein an amount of the plurality of diamond particles are provided such that the interface region has a total coefficient of thermal expansion based on the equation:

$$\alpha_{total} = \sum_i \alpha_i V_i$$

wherein $\alpha_{total}$ is the total coefficient of thermal expansion, $\alpha_i$ is a coefficient of thermal expansion of an $i^{th}$ component, and $V_i$ is the volume fraction of the $i^{th}$ component; and wherein the $i^{th}$ component comprises the carbide within the interface region and the diamond within the interface region.

34. The method of claim 21, further comprising removing metal from the interstitial spaces in the polycrystalline diamond body after it is attached to the reduced-CTE substrate at a selected depth from an outer surface of the polycrystalline diamond body.

35. The method of claim 21, wherein the attaching a polycrystalline diamond body to the upper surface comprises placing a diamond mixture adjacent the upper surface and subjecting the reduced-CTE substrate and the diamond mixture to high pressure high temperature sintering conditions to form the polycrystalline diamond body attached to the reduced-CTE substrate.

36. The method of claim 21, wherein each of the plurality of diamond particles have a size in the range of 200 mesh to 18 mesh.

37. The method of claim 21, wherein the plurality of diamond particles are selected from at least one of natural diamond and synthetic diamond.

* * * * *